US006802143B1

(12) United States Patent
Rachowitz et al.

(10) Patent No.: US 6,802,143 B1
(45) Date of Patent: Oct. 12, 2004

(54) RELIABLE, ROTATING, ILLUMINATED ADVERTISING UNIT

(75) Inventors: Bernard I. Rachowitz, Lloyd Neck, NY (US); Anthony Mascolo, Islip Terrace, NY (US); Robert Benoit, Oakdale, NY (US); Joseph Lerner, Kings Park, NY (US)

(73) Assignee: Fuel Cell Components and Integrators, Inc., Hauppauge, NY (US)

( * ) Notice: Subject to any disclaimer, the term of this patent is extended or adjusted under 35 U.S.C. 154(b) by 0 days.

(21) Appl. No.: 10/447,469

(22) Filed: May 28, 2003

(51) Int. Cl.[7] ..... G09F 13/00
(52) U.S. Cl. ..... 40/502; 40/473; 40/493
(58) Field of Search ..... 40/473, 493, 490, 40/502, 506, 554; 312/125, 234

(56) References Cited

U.S. PATENT DOCUMENTS

| | | | | | |
|---|---|---|---|---|---|
| 2,555,070 | A | * | 5/1951 | Wood | 312/125 |
| 3,105,315 | A | * | 10/1963 | Snethen | 40/502 |
| 4,179,168 | A | * | 12/1979 | Isaac et al. | 312/125 |
| 5,947,584 | A | | 9/1999 | Passanante et al. | 362/154 |
| 6,148,552 | A | | 11/2000 | Dumontier et al. | 40/473 |
| 6,345,458 | B1 | * | 2/2002 | Garibian | 40/506 |
| 6,389,719 | B1 | * | 5/2002 | Smith | 40/473 |
| 6,455,767 | B1 | | 9/2002 | Muller | 136/245 |

* cited by examiner

*Primary Examiner*—S. Joseph Morano
*Assistant Examiner*—Lars A. Olson
(74) *Attorney, Agent, or Firm*—Mark Levy & Associates

(57) ABSTRACT

A reliable, rotating, illuminated advertising display unit that utilizes independent display modules housing lights and advertising material. These are easily removed from the base unit for shipping, assembly, and replacement. Optionally, AMLCD, plasma, or similar flat-panel displays may be used in the display modules. The display modules surround a hollow central compartment that may be used for storing, collecting, or displaying products such as food or beverages, or as a trash container. Power is transmitted from the base via a slip ring to the lighting contained in the display modules so as to display advertising or similar matter. The rotational capability is provided via a motor, a gearing arrangement, a central tapered roller bearing, and rollers. The unit's power is provided by AC power when available, or by utilizing a fuel cell, e.g., a proton exchange membrane (PEM), methanol solid oxide, photovoltaic cells, battery, or some combination thereof.

24 Claims, 4 Drawing Sheets

RELIABLE, ROTATING, ILLUMINATED ADVERTISING UNIT

FIELD OF THE INVENTION

The invention pertains to advertising displays and, more particularly, to a lighted, rotating advertising display unit that has storage space for comestibles, trash, ice, etc., and is mobilized and powered by AC line power or an internal power source, such as a battery or a fuel cell.

BACKGROUND OF THE INVENTION

In the art of lighted displays, location is a major consideration. In order to reach as many people as possible, advertising displays are often placed in areas of ingress and egress, such as motel hallway alcoves and airport hallways. Many desirable but remote locations cannot be adequately served by lighted displays, however, owing to the lack of availability of power outlets to energize the light fixtures of these units. These types of remote locations include beaches, parks, building entrances and exits, swimming pool and hot tub areas, and building facades. In some of these areas, AC line power is readily available and may be utilized to illuminate and rotate the inventive advertising unit. In other areas, however, AC power is not readily or conveniently available. Consequently, an internal power source must be provided.

One way of internally powering such an advertising unit is to use internal batteries. The batteries needed to provide lighting energy are expensive to maintain, requiring periodic replacement, which increases the labor costs for maintaining the displays. Recent advances in battery technology, however, have resulted in more efficient, longer lasting batteries that may be suitable for such an application.

Rechargeable batteries could be used but require recharging from an external source of electrical power. Coupling high efficiency batteries with a power source such as photovoltaic cells is another alternative for powering such an advertising unit. Most recently, compact fuel cells have been developed for commercial use. In an alternate embodiment, it would make sense to modify a lighted advertising unit of the present invention to obtain its necessary power from one or more built-in fuel cells.

The present invention provides a lighted advertising display unit comprising a number of independent, self-contained display modules located above a base housing the electrical and mechanical components necessary to illuminate, rotate, and control the display modules. In embodiments utilizing a fuel cell, an easily accessible compartment for housing one or more fuel cells may also be provided. The fuel cell allows the display modules of this invention to be electrically powered for both illumination and rotation. Rotationally mobilizing the inventive display increases the eye-catching ability of the lighted advertising disposed upon or within the display module. The batteries, fuel cell, or other self-contained power source provide the needed electrical power to achieve mobility when an electrical power line is not available.

In the fuel cell powered embodiment of the invention, the display unit also comprises compartments for housing fuel to feed the fuel cells, such as hydrogen or methanol canisters. The electric energy supplied by the power source is used to power an electric drive motor, which in turn causes the display modules to rotate upon a centrally located support bearing. A hollow, tapered liner is carried upon a platform, whose support column runs through the centrally located bearing in the base of the unit. Optionally, a removable can may be placed inside the liner. The display modules are cylindrically arranged and mounted to three vertically disposed stanchions upwardly projecting from the base. A slip ring assembly is used to transmit power from the stationary base to the rotating display modules and the motor.

The hollow liner or removable can may be used for many purposes. When used as a trash receptacle, the inner surface of the removable can may be lined or coated for ease of cleaning. The hollow liner is supported by a central column and can support located in the base. The hollow liner is used for storing comestibles, ice, etc. The removable can may be used to receive trash at beaches and parks. An optional top, typically domed, has spaced-apart inlet areas for depositing trash or refuse into the removable can housed within the liner.

Each independent display module has its own illumination source, which, in combination with a light diffusing screen, illuminates advertising or other graphic material to be displayed on each display module. In still other embodiments of the inventive display, direct view displays such as active matrix liquid crystal display (AMLCD), organic liquid crystal displays (OLED), or plasma displays or similar devices may be used to provide the advertising display. In such units, the display may be animated or may consist of multiple (i.e., more than three) different displays, thus possibly improving the saleability of the advertising space. In some environments (e.g., a zoo, etc.), educational material could be displayed.

Because the independent display modules may be removed and nested with the stanchions, the inventive advertising display unit may be shipped in a compact fashion and easily assembled on site.

DISCUSSION OF RELATED ART

In U.S. Pat. No. 6,455,767, issued Sep. 24, 2002 to Hermann-Frank Muller for WEATHER RESISTANT FLAG HAVING A FLAGSTAFF, an illuminated flag is illustrated, which may derive its power for illumination from a fuel cell. No teaching is provided by MULLER for connection of the flag to an external power source such as an AC power outlet. Unlike the MULLER device, the inventive display device provides space for changeable, illuminated displays embodied in independent display modules. Neither does MULLER teach any mechanism for rotating an advertising display nor is any provision made for using a direct view display device in one or more independent display modules. In addition to an internal power source such as batteries or a fuel cell, the inventive advertising display unit may connect to an external power source like an AC power outlet.

Illuminated displays of a similar type to that of the invention can be observed with reference to U.S. Pat. No. 5,947,584, issued on Sep. 7, 1999 to Passanante et al. for ILLUMINATED TRASH RECEPTACLE, which discloses a trash receptacle providing illumination of an advertisement display on the unit's side walls. PASSANANTE et al. fail, however, to teach a rotating display as provided by the present invention. Also, unlike the advertising display unit of the present invention, PASSANANTE et al. utilize edge lighting rather than backlighting.

U.S. Pat. No. 6,148,552, issued on Nov. 21, 2000 to Dumontier et al. for DEVICE FOR ROTATABLY DISPLAYING ADVERTISING MATERIAL, discloses a device comprising a revolving member mounted on the base so as to permit rotation of the advertising material. In contradistinction, DUMONTIER et al. teach a system wherein an internal core rotates within a fixed outer cylinder. A single outer cylinder is provided, but repair thereof is time-consuming. DUMONTIER et al. utilize an articulated arm and driving wheel bracket fixedly mounted on a circular plate and a driving wheel mounted on the driving wheel bracket to drivingly engage an underface of the inner horizontal portion of the ring shaped inner tubular member holder as a drive system. The inventive display unit utilizes a direct gear drive, which eliminates any need for a friction drive using an articulated arm or the like.

In addition, DUMONTIER et al. are silent as to a source of power for their display. Consequently, it is assumed that the patentees anticipated connection to only an electrical source exterior to the display. The inventive display device, on the other hand, may be self-powered, thereby freeing it from the confines of the electrical power grid and allowing its placement in areas remote from such power or where an electrical connection would otherwise be too expensive or inconvenient to install.

SUMMARY OF THE INVENTION

In accordance with the present invention, there is described a reliable, rotatable, illuminated advertising display unit. Power is provided either by AC power mains or by an internal power source such as a battery or a fuel cell. In an embodiment using an internal fuel cell, an easily accessible compartment for housing the fuel cell is provided. Rotationally mobilizing the inventive display unit increases the eye-catching appeal of the lighted advertising disposed upon multiple display modules carried thereupon. The display unit also comprises compartments used for housing fuel to feed the fuel cells, such as hydrogen or methanol canisters, when required.

In non-fuel cell embodiments, these compartments are used for other purposes. The externally (e.g., AC power. grid) or internally supplied electric energy is used to power an electric drive motor, which in turn causes the display modules to rotate about a centrally located support bearing disposed in the base of the unit.

A rotating structure consisting of a plate supported by a central roller bearing surrounding a vertical column supports multiple vertical stanchions. Multiple, removable, independent, self-contained modules are secured between the stanchions. A stationary hollow liner or can is disposed at an interior region of the display unit, surrounded by the stanchions and modules. Typically, the hollow liner contains an optional, removable inner can. The hollow liner is used for storing comestibles, ice, or discarded trash at beaches and parks. An optional top, typically a domed top, disposed over the unit has spaced-apart inlet areas for refuse placed into the can contained therein. Optionally, the liner may have a taper in its vertical walls to facilitate nesting for shipping or other purposes.

In the embodiment chosen for purposes of disclosure, three independent advertising modules are disposed between and supported by three vertical stanchions. Each module contains a backlighting source, typically tubular fluorescent lamps, which illuminate the advertising disposed upon the display module through a light-diffusing screen. In alternate embodiments, direct view display devices such as active matrix liquid crystal display (AMLCD) or plasma displays may be used in one or more of the display modules to provide readily changeable or animated displays.

The advertising display unit of the invention may be compactly shipped with the display modules, stanchions, and base nested. This saves storage space and increases distribution efficiency. The advertising display unit may then be readily assembled on site.

It is an object of this invention to provide an improved, illuminated, advertising display unit.

It is another object of the present invention to provide an illuminated and rotationally mobile advertising display unit for use in remote areas where electrical outlets are not available to supply power.

It is a further object of the present invention to provide an illuminated and rotationally mobile advertising display unit having a self-contained source of electrical power.

It is an additional object of the present invention to provide an illuminated and rotationally mobile advertising display unit wherein the self-contained power source may be a battery or a fuel cell.

It is a still further object of the present invention to provide an illuminated and rotationally mobile advertising display unit which uses direct view electronic displays such as AMLCD, OLED, or plasma panels in the display modules to provide readily changeable or animated displays.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like components and elements of the apparatus of this invention will bear the same designations or numbering throughout the figures.

DESCRIPTION OF THE PREFERRED EMBODIMENT

Generally speaking, there is described a rotating, illuminated advertising display unit that obtains its power from either an AC electrical connection or, optionally, from an internally housed power source. The internal power source may be one or more batteries, a fuel cell, a wind-powered or photovoltaic generator, or the like. Energy sources may be combined to provide a practical, long lasting energy source for powering the advertising unit.

A motor rotationally drives a plurality of independent, interchangeable, self-contained display modules supported by stanchions anchored to a rotating platform. The rotation increases the eye-catching appeal of the lighted advertising disposed upon the display screen. When required, the inventive advertising unit also comprises compartments for housing fuel to feed the fuel cell, such as hydrogen or methanol canisters, for example.

Figure 1:
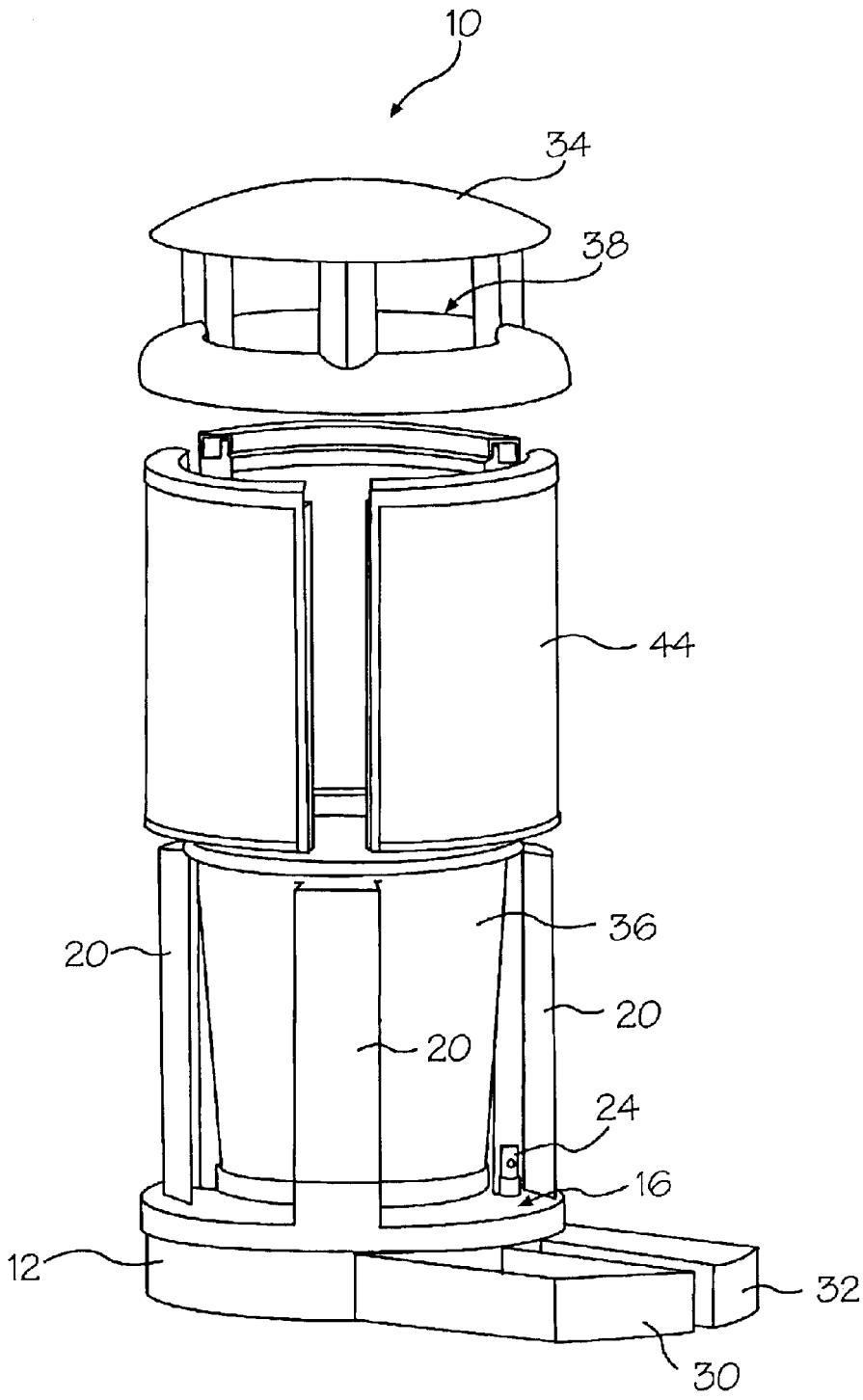
FIG. 1 is a perspective, exploded view of the illuminated, rotating advertising unit of this invention.
Figure 2:
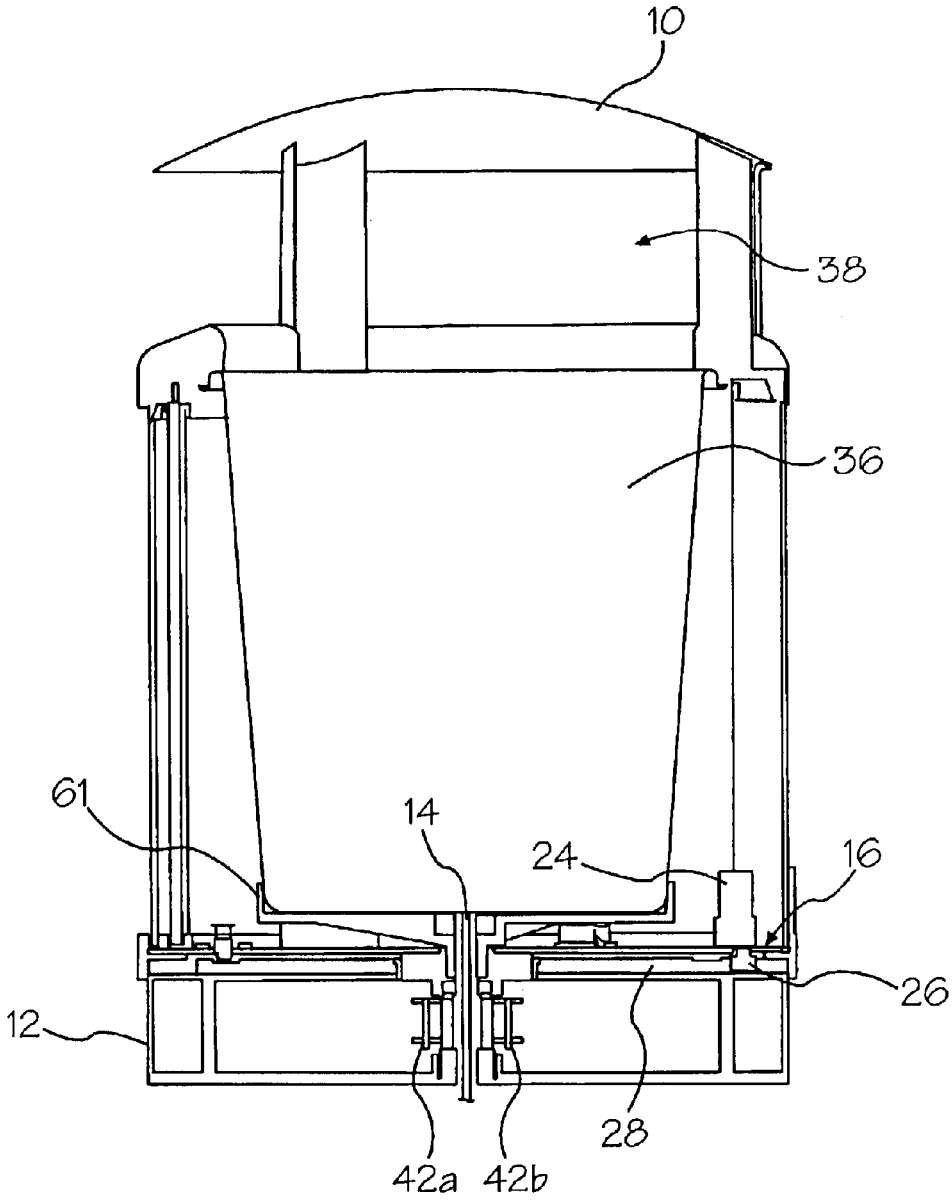
FIG. 2 is a front, sectional view of the illuminated, rotating advertising unit shown in FIG. 1.
Figure 3:
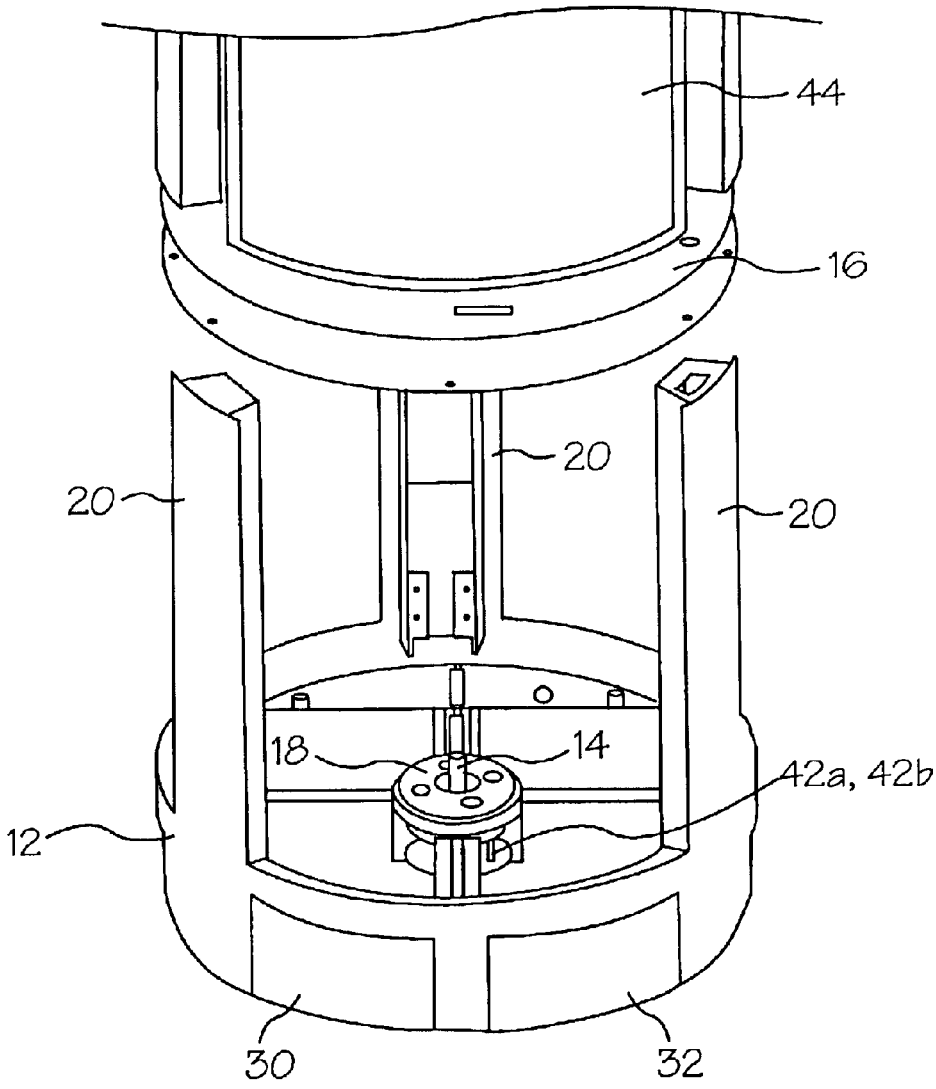
FIG. 3 is a detailed perspective, exploded view of the base region of the advertising unit of FIG. 1.

Now referring to FIGS. 1, 2, and 3, a perspective, exploded view of the illuminated, rotating advertising display; a front, sectional view; and a detailed front sectional view of advertising unit 10 of the invention are respectively provided. The advertising unit 10 comprises a base 12 to which a central column 14 is anchored. A rotating platform 16 is suspended from a column 14 by bearing 18. Three, spaced-apart stanchions 20 vertically project upwards from rotating platform 16. A hollow liner (i.e., a can) 36 is supported by a central column 14 and can support 61.

A motor 24 is disposed vertically on the rotating platform 16. The motor 24 has a shaft (not shown) directed downward through an opening (not shown) in the rotating platform 16. A gear 26 is fitted to a distal end of the motor shaft. The gear 26 is arranged to engage teeth on the outer perimeter of a stationary gear 28 attached to the base 12. Rotation of the shaft of the motor 24 propels the rotating platform 16 through interaction with the motor gear 26 and the stationary gear 28.

In a first embodiment, the base 12 comprises two pullout drawers 30 and 32. Drawer 30 houses a fuel cell (not shown), which is commercially available from a number of manufacturers, including the present assignee.

The fuel cell can be a proton exchange membrane (PEM), which is hydrogen fueled by a canister contained in pullout drawer 32. The oxygen in the air will react with the hydrogen in the fuel cell to produce electricity and water. The water is allowed to drain into the ground below the base 12, or may be contained in a pullout tray (not shown). Other types of fuel cells may be used with this invention. Methanol or solid oxide fuel cells, for example, may also be deposited within drawer 30. Drawer 32, in the case of a methanol fuel cell, is then filled with a canister containing methanol, and the canister is connected to the fuel cell inlet (not shown).

In alternate embodiments, drawers 30, 32 may be eliminated and replaced with other suitable access to an internal compartment in the base 12. This compartment may be used to house batteries (not shown) or other components necessary to power the display 10.

The advertising display unit 10 also comprises an optional top 34 (typically dome shaped), which attaches the stanchions 20. The top 34 has spaced-apart inlets 38 into which trash from the beach or park area can be thrown. The trash will then be deposited into the hollow receptacle 36 below. This hollow liner 36 can also be used to store ice, soft drinks, or other comestibles. Optionally, the liner (can) 36 may be equipped with a removable inner can (not shown), which facilitates emptying trash when the display unit 10 is used as a trash receptacle.

A motor 24 carried on rotating platform 16, typically adjacent one of the vertical stanchions 20, rotates with the stanchions 20. The slip ring assembly 42*a*, 42*b* is disposed on central column 14 and on rotating platform 16, respectively. The slip ring assembly 42a, 42b allows transmission of electrical power from the stationary base 12 to the motor 24 on the rotating platform 16. Power is thereby also provided for the lamps 52 (FIG. 4) within self-contained modules 44 as will be described in detail hereinbelow.

Figure 4:
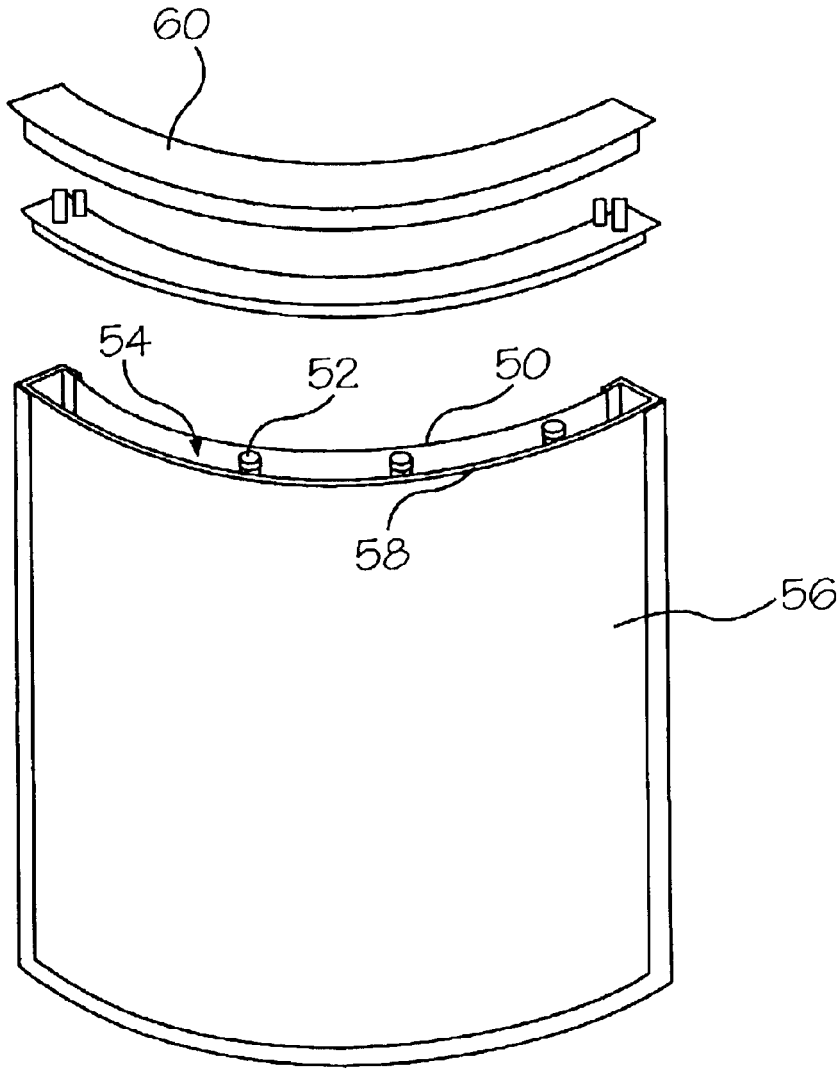
FIG. 4 is a detailed perspective, exploded view of one of the display modules of the advertising unit of FIG. 1.

Referring now also to FIG. 4, a detailed, perspective view of an independent, removable, self-contained module 44 is shown. Modules 44 are typically secured to vertical stanchions 20. In the embodiment chosen for purposes of disclosure, three modules 44 have been shown. It will be recognized that other numbers of modules 44 could likewise be used with suitable modifications to the advertising display unit 10. Each module 44 is a hollow, curved structure having a reflective back member 50. One or more lamps 52 are disposed vertically within the module 44. These lamps 52 are electrically connected to power transmitted through the slip ring assembly 42*a*, 42*b*. While fluorescent tubes have been chosen for purposes of disclosure, other light generating devices such as incandescent lamps, light emitting diodes (LEDs), etc., may also be used.

For purposes of disclosure, three lamps 52 are shown in each module 44. It will be recognized that other numbers of lamps could be utilized to meet a particular operating circumstance or environment. A diffuser plate 54 is disposed in front of the lamps 52. An outer, transparent panel 56 is disposed outwardly from a diffuser plate 54 with a small space left therebetween that is accessible from the slot 58 disposed at the top of the module 44. The slot 58 is provided to allow translucent advertising or other material for display to be inserted in the space between the diffuser plate 54 and the outer transparent panel 56. A cover 60 is provided to close and seal the slot 58. Each module 44 is sealed, thereby making it weatherproof. In the preferred embodiment, all operating components except an inverter are contained in each module 44. It will be recognized that, depending on the size of such an inverter, it too may be included in the self-contained module 44.

In still other embodiments, one or more of the modules 44 may be replaced by a direct view electronic display. Typically AMLCD, OLED, or plasma flat panel displays would be chosen for such service. It will be recognized that other flat panel display devices, either now known or not yet invented, could readily be used with the inventive display 10.

Optionally, display unit 10 may be equipped with a remote communication capability, not shown. Such capability would allow controlling the basic functions of various elements of the display unit 10 (e.g., turning the lights 55 and/or the motor 24 on or off). In addition, remote maintenance could be performed.

In more sophisticated embodiments of the display unit 10, when display modules 44 are implemented using plasma or other flat-panel displays, content for the display-modules 44 could be wirelessly communicated to the display unit 10. With a two-way wireless communication system, remote maintenance could be performed. If the display unit 10 were equipped for interaction with a passerby, a counter contained in the display unit 10 could be remotely queried. It will be recognized that many other control functions germane to an illuminated display apparatus could also be implemented.

Many technologies currently exist for implementing such remotely controlled features. For units within line-of-site of a controlling facility, IR, or other visible light communication, strategies may be used. Any known RF-based wireless communication strategy could, of course, also be used. In exotic implementations, direct satellite communication may be used.

It will be recognized that the display 10 is intended for either indoor or outdoor deployment. Consequently, its construction is weatherproof. The sensitive internal components and regions are suitably sealed using techniques well known to those skilled in the art of constructing outdoor displays.

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Having thus described the invention, what is desired to be protected by Letters Patent is presented in the subsequently appended claims.

What is claimed is:

1. A lighted, rotating advertising display unit, comprising:

a base;

at least two illuminated, removable advertising modules supported by, and rotatively movable with respect to, said base;

means for rotatively moving said at least two illuminated, removable advertising modules operatively connected thereto and to said base, said means for rotatively moving comprising a gear; and a power source electrically connected to said means for rotatively moving and said illuminated, removable advertising modules, for supplying power to illuminate and rotate said illuminated advertising module.

2. The lighted, rotating advertising display unit in accordance with claim 1, wherein said means for rotatively moving comprises an electric motor.

3. The lighted, rotating advertising display unit in accordance with claim 2, wherein said electric motor is disposed on said illuminated advertising module and comprises a gear adapted for interactively engaging teeth of a stationary gear disposed on said base.

4. The lighted, rotating advertising display unit in accordance with claim 1, wherein said power source comprises at least one of the devices: battery, fuel cell, photovoltaic cell.

5. The lighted, rotating advertising display unit in accordance with claim 1, wherein said power source comprises means for operatively connecting said advertising display unit to a source of electrical power external thereto.

6. The lighted, rotating advertising display unit in accordance with claim 5, wherein said means for operatively connecting said advertising display unit to an external source of electrical power comprises a connection to an AC electrical outlet with means for converting AC power to DC power.

7. The lighted, rotating advertising display unit in accordance with claim 1, wherein said illuminated advertising module comprises a plurality of self-contained, independent display modules.

8. The lighted, rotating, advertising display unit in accordance with claim 7, wherein at least one of said plurality of self-contained, independent display modules has, when viewed from a top surface thereof, one of the profiles: curvilinear and rectangular.

9. The lighted, rotating advertising display unit in accordance with claim 7, wherein each of said plurality of self-contained, independent display modules comprises an internal light source.

10. The lighted, rotating advertising display unit in accordance with claim 9, wherein said light source comprises at least one of the devices: a fluorescent tube, an incandescent lamp, and an LED.

11. The lighted, rotating advertising display unit in accordance with claim 9, wherein at least one of said plurality of self-contained, independent display modules further comprises at least one of the optical components: a reflective back plate, a diffuser screen, and an outer transparent panel.

12. The lighted, rotating advertising display unit in accordance with claim 7, wherein at least one of said plurality of display modules comprises a direct view display.

13. The lighted, rotating advertising display unit in accordance with claim 7, wherein said direct view display comprises one of the display types: AMLCD, OLED, and plasma.

14. The lighted, rotating advertising display unit in accordance with claim 7, wherein said power source comprises a slip ring assembly adapted to transfer at least power between said power source and said plurality of display modules.

15. The lighted, rotating advertising display unit in accordance with claim 7, wherein said lighted, rotating advertising display unit is substantially weatherproof.

16. The lighted, rotating advertising display unit in accordance with claim 1, further comprising a hollow receptacle supported by said base and disposed in a central, hollow space within said lighted, rotating advertising display unit.

17. The lighted, rotating advertising display unit in accordance with claim 16, wherein said hollow receptacle comprises a top portion having an opening therein for depositing materials into said hollow receptacle.

18. The lighted, rotating advertising display unit in accordance with claim 7, further comprising a platform for supporting a plurality of stanchions, said platform being supported for rotation upon said base.

19. The lighted, rotating advertising display unit in accordance with claim 18, wherein said platform is supported for rotation upon said base by a bearing affixed to a central column supported by said base.

20. The lighted, rotating advertising display unit in accordance with claim 19, wherein said bearing is a tapered roller bearing.

21. The lighted, rotating advertising display unit in accordance with claim 20, wherein said platform is additionally supported for rotation upon said base by an auxiliary roller disposed between said base and a peripheral portion of said platform.

22. The lighted, rotating advertising display unit in accordance with claim 1, wherein said illuminated advertising module is substantially cylindrical.

23. The lighted, rotating advertising display unit in accordance with claim 1, wherein said illuminated advertising module further comprises means for wireless communication therewith.

24. The lighted, rotating advertising display unit in accordance with claim 23, wherein said means for wireless communication provides at least one of the functions: performing maintenance on said display unit, communicating content to be displayed to said display unit, and remotely, selectively turning on and off a function of said display unit.

* * * * *